US010787333B2

(12) United States Patent
Castells et al.

(10) Patent No.: US 10,787,333 B2
(45) Date of Patent: Sep. 29, 2020

(54) ROLLER ADAPTERS

(71) Applicant: Hewlett-Packard Development Company, L.P., Houston, TX (US)

(72) Inventors: Raimon Castells, Barcelona (ES); Aviv Hassidov, Sant Cugat del Valles (ES); Marcos Arminana, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 257 days.

(21) Appl. No.: 15/760,290

(22) PCT Filed: Sep. 28, 2015

(86) PCT No.: PCT/US2015/052601
§ 371 (c)(1),
(2) Date: Mar. 15, 2018

(87) PCT Pub. No.: WO2017/058141
PCT Pub. Date: Apr. 6, 2017

(65) Prior Publication Data
US 2018/0257890 A1 Sep. 13, 2018

(51) Int. Cl.
*B65H 16/02* (2006.01)

(52) U.S. Cl.
CPC ..... *B65H 16/028* (2013.01); *B65H 2301/331* (2013.01); *B65H 2301/415013* (2013.01); *B65H 2402/31* (2013.01); *B65H 2801/03* (2013.01)

(58) Field of Classification Search
CPC ..... B65H 16/08; B65H 16/028; B65H 23/02; B65H 2301/331; B65H 2301/415013; B65H 2402/31; B65H 2404/15212; B65H 2801/03
See application file for complete search history.

(56) References Cited

U.S. PATENT DOCUMENTS 3,154,263 A * 10/1964 Fischer, Jr. ..... B65H 16/08 242/564.5
3,743,205 A * 7/1973 Misrach ..... B21C 47/18 242/595.1
5,815,186 A 9/1998 Lewis et al.
(Continued)

FOREIGN PATENT DOCUMENTS

JP H07330194 12/1995
JP H10157885 6/1998
(Continued)

OTHER PUBLICATIONS

Kim, C.H. et al., "Design of Multi-purposed Roll-to-roll Printing System for Printed Electronics", Nov. 23-26, 2011, Ubiquitous Robots and Ambient Intelligence (URAI), 2011 8th International Conference on, pp. 690-691. IEEE.

*Primary Examiner* — William A. Rivera
(74) *Attorney, Agent, or Firm* — HP Inc. Patent Department

(57) ABSTRACT

An example roller adapter may comprise a cradle, a first roller rotatably disposed on a top side of the cradle, a second roller rotatably disposed on the top side of the cradle, and an alignment knob disposed on a base of the cradle. The first and second rollers may extend in a substantially parallel direction. The first and second roller may rotatably support a roll of flexible print media.

20 Claims, 5 Drawing Sheets

(56) References Cited

U.S. PATENT DOCUMENTS

| | | | | |
|---|---|---|---|---|
| 6,024,322 | A * | 2/2000 | Skelly | B41J 29/48 116/67 A |
| 6,209,819 | B1 * | 4/2001 | Habisreitinger | B65H 19/12 242/553 |
| 6,296,403 | B1 | 10/2001 | Duchovne | |
| 6,561,453 | B1 | 5/2003 | Shinga | |
| 7,341,219 | B2 | 3/2008 | Myers et al. | |
| 8,118,392 | B2 | 2/2012 | Groenenboom et al. | |

FOREIGN PATENT DOCUMENTS

| | | |
|---|---|---|
| JP | 2006137509 | 6/2006 |
| JP | 2009269722 | 11/2009 |

* cited by examiner

ROLLER ADAPTERS

BACKGROUND

Printing devices may have the ability to deposit a fluid such as ink on various types of print media. Print media may include flexible media disposed in a roll, or flat or rigid substrates or media such as card stock or another stiff material. Rigid print media may be supported by a primer media table or extension table prior to entering the input path of the printer, after exiting the output path of the printer, or both.

DETAILED DESCRIPTION

Printing devices such as printers may have the ability to deposit a fluid such as ink on various types of print media. Print media may include flexible media disposed in a roll, or flat or rigid media such as card stock, poster board, signs, or another stiff material. Printing devices may have the ability to switch from printing on a flexible print media to priming on a rigid print media. Rigid print media may be difficult to handle, depending on the size and/or weight of the media. As such, the rigid print media may be supported by a printer media table or extension table prior to entering the input path of the printer, after exiting the output path of the printer, or both. The printer media tables may help with aligning the border of the media with the printer, and may also help avoid applying unnecessary frictional forces to the media, and help avoid inflicting dents, marks, or other defects upon the media. As such, a high degree of precision and accuracy is needed when installing and aligning such printer media tables to the printer. In some situations, it may be desirable to change from printing on a rigid print media, to printing on a flexible print media, which may be disposed on a roll. Further, in some situations, it may be desirable to print on flexible media prior to printing on rigid media. The flexible media run may be a short run or a proofing run prior to printing a final product upon the rigid media. In such situations, the printer media tables before the input path or after the output path of the primer, or both, may be disengaged from the printer and replaced with structures that may support a roll of flexible media, or vice versa. Such a transition from a rigid media support structure to a flexible media support structure and vice versa may be complex and difficult or arduous to accomplish, and may include extensive downtime, or an extended period of time for which the printer is inoperative.

Implementations of the present disclosure provide roller adapters that support a roll of flexible print media upon a primer media table that is normally used to support rigid print media. Further, the roller adapters may easily and quickly engage with a printer media table, such that a printer or printing device can quickly and easily switch from printing on rigid print media to printing on flexible print media without uninstalling the primer media table and installing a structure to support a roll of flexible print media in its place. Further, the roller adapters may easily disengage with the printer media table, such that the printer can quickly and easily return to printing on rigid print media.

Figure 1A:
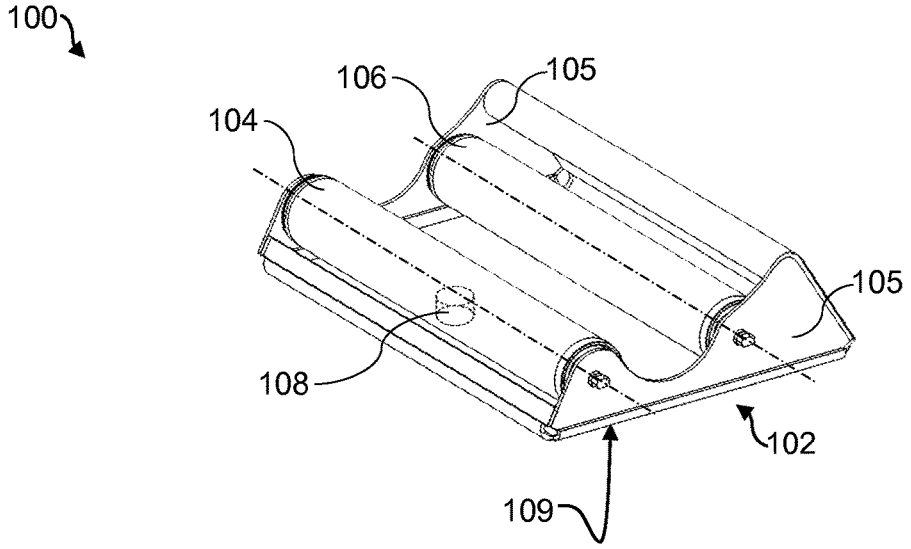
FIG. 1A is a perspective view of an example roller adapter.
Figure 1B:
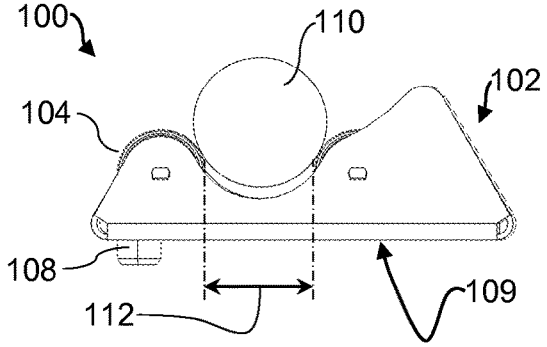
FIG. 1B is a side view of an example roller adapter.
Figure 1C:
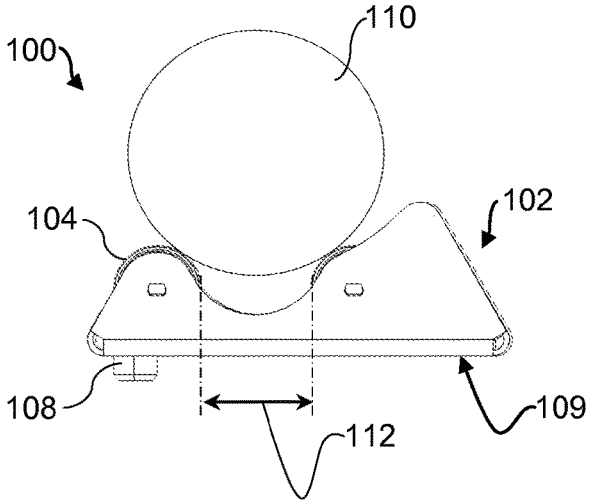
FIG. 1C is a side view of an example roller adapter.

Referring now to FIG. 1A, a perspective view of an example roller adapter 100 is illustrated. The example roller adapter 100 may comprise a frame, which may also be referred to as a cradle, 102, a first roller 104, and a second roller 106. The example roller adapter 100 may further include an alignment feature, sometimes referred to as an alignment pivot or knob, 108 disposed on a base 109 of the cradle 102. Referring additionally to FIGS. 1B-C, side views of example roller adapter 100 rotatably engaging and supporting a roll of flexible print media 110 are illustrated.

The frame or cradle 102 may be a rigid structure or housing to which the first and second rollers 104 and 106 are rotatably attached in such a fashion such that the rollers ma receive and rotatably support a roll of flexible print media 110. In some implementations, the frame or cradle 102 may have a top side on which the first and second rollers 104 and 106 are disposed, and may, further, have a base or bottom side 109 substantially opposite that of the top side. The cradle 102 may engage with a separate component or primer structure, such as a print media table, by resting the base 109 on such a separate component, or a top surface thereof, such that the base 109 is disposed in between the separate component and the top side of the cradle 102, and the base 109 may transfer the weight of the roll of flexible print media 110 to the separate component or printer structure. In some implementations, the cradle 102 may be constructed of a unitary piece of material, or be constructed out of multiple pieces of material which may then be mechanically assembled and fastened to one another. In further implementations, the cradle 102 may comprise a metallic material such as steel, aluminum, titanium, alloys thereof, or other metallic materials. In yet further implementations, the cradle 102 may be constructed out of a sheet material, such as sheet steel or sheet aluminum, and bent, folded, or stamped into the desired geometry. In other implementations, the cradle 102 may be cast, or may be formed out of a solid piece of material, such as billet steel or aluminum.

The first and second rollers 104 and 106 may each be rigid elongate structures having a central longitudinal axis and a circumferential surface around such an axis. In some implementations, the first and second rollers 104 and 106 may comprise a cylindrical geometry. In other implementations, the first and second rollers 104 and 106 may comprise another elongate geometry that allows the roller to rotate along its longitudinal axis. In some implementations, each of the first and second rollers 104 and 106 may comprise a smooth metallic outer surface, such as polished aluminum, steel, or another polished metallic material. In some implementations, each of the rollers 104 and 106 may include a central spindle or axle extending along the central longitudinal axis, and about which the circumferential outer surface of the roller may rotate. The rollers 104 and 106 may include rotational bearings disposed in between the spindle and the outer circumferential surface, in order to minimize the rotational friction about the spindle. In some implementations, the first and second rollers 104 and 106 may be structurally similar to one another, and may further comprise similar dimensions and sizes. In further implementations, the first and second rollers 104 and 106 may comprise circumferential outer surfaces having differing diameters from one another. In yet further implementations, each of the first and second rollers 104 and 106 may be similar to a conveyor roller.

The first and second rollers 104 and 106 may each be capable of moving an object in a translational fashion through rotation of the roller along the central longitudinal axis of the roller. The rollers 104 and 106 may also be capable of moving a cylindrical object in a rotational fashion through rotation of the roller along its longitudinal axis, whereas the rotation of the object may be the opposite rotational direction than that of the rollers. The first and second rollers 104 and 106 may be disposed on or within the cradle 102 such that the two rollers extend in a substantially parallel direction. In this context, substantially parallel direction may refer to the rollers 104 and 106 extending in the same direction close enough to parallel such that, together, the rollers may support a cylindrical object such that the cylindrical object may rotate along its own longitudinal axis through the rotation of each of the rollers 104 and 106. The two rollers may be disposed on or within the cradle 102 by having their respective spindles or central axles fixed to side portions 105 of the cradle 102, in some implementations. The first and second rollers 104 and 106, further, may each be rotatably engaged with the cradle 102 through rotational bearings so as to minimize the rotational friction of each roller. Referring still to FIGS. 1B-C, the first and second rollers 104 and 106 may be disposed on or within the cradle 102 such that the rollers may structurally and rotationally engage with and support a roll of flexible print media 110 having a diameter that is greater than a perpendicular distance 112 between the closest edges of the first and second rollers 104 and 106. In some implementations, the rollers 104 and 106 may continually support a roll of flexible print media 110 as its diameter decreases as print media is pulled or fed from the roll. The rollers 104 and 106 may support such a roll of flexible print media 110 until the roll's diameter is no longer greater than the perpendicular distance 112 between the closest edges of the first and second rollers 104 and 106.

The example roller adapter 100 may further comprise an alignment pivot or knob 108 disposed on, or extending from the base 109 of the cradle 102. The alignment knob 108 may be a rigid protrusion extending from the base or bottom side 109 of the cradle 102. In some implementations, the alignment knob 108 may have a geometry and size such that it may be inserted into and rotate within a complementary receptacle or cavity disposed in a separate component, or a top surface thereof that may receive the base 109 of the roller adapter 100. In some implementations, the alignment knob 108 may comprise a cylindrical geometry and may engage with a complementary receptacle or cavity having an elliptical or round geometry. In some implementations, the alignment knob 108 may be generally disposed along a centerline of the cradle 102, or a line substantially bisecting the longitudinal axes of the rollers 104 and 106. In further implementations, the alignment knob 108 may actually be a cavity, receptacle, or aperture on the cradle 102 that may engage with and receive a complementary protrusion on a separate component upon which the roller adapter 100 is disposed.

Figure 2A:
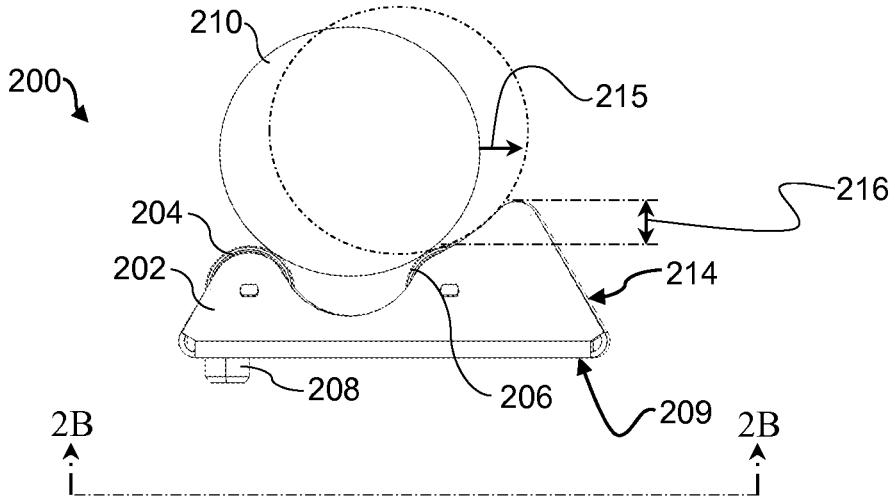
FIG. 2A is a side view of an example roller adapter.

Referring now to FIG. 2A, a side view of an example roller adapter 200 is illustrated. Example roller adapter 200 may be similar to example roller adapter 100. Further, the similarly named elements of example roller adapter 200 may be similar in function and/or structure to the elements of example roller adapter 100, as they are described above. Roller adapter 200, similar to roller adapter 100, may comprise a frame or cradle 202, a first and second roller 204 and 206, and an alignment pivot or knob 208, disposed on a base or bottom side 209 of the frame or cradle 202. Further, example roller adapter 200 may include a support surface 214. The support surface 214 may be an integral or unitary part of the cradle 202, or it may be a separate component that is mechanically assembled onto and fastened to the cradle 202. The support surface may be a stiff or rigid structure that extends from the base 209 to a height beyond that of the top-most surface of the second roller 206, such that there is a height differential 216 between the top surface of the support surface 214, and the top-most surface of the second roller 206, as shown in FIG. 2A. Thus, if a roll of flexible print media 210 were to roll over the second roller 206 in a direction 215 away from the first roller 204, as is shown in phantom lines in FIG. 2A, the support surface would prevent the roll 210 from falling off of the back of the roller adapter 200.

Figure 2B:
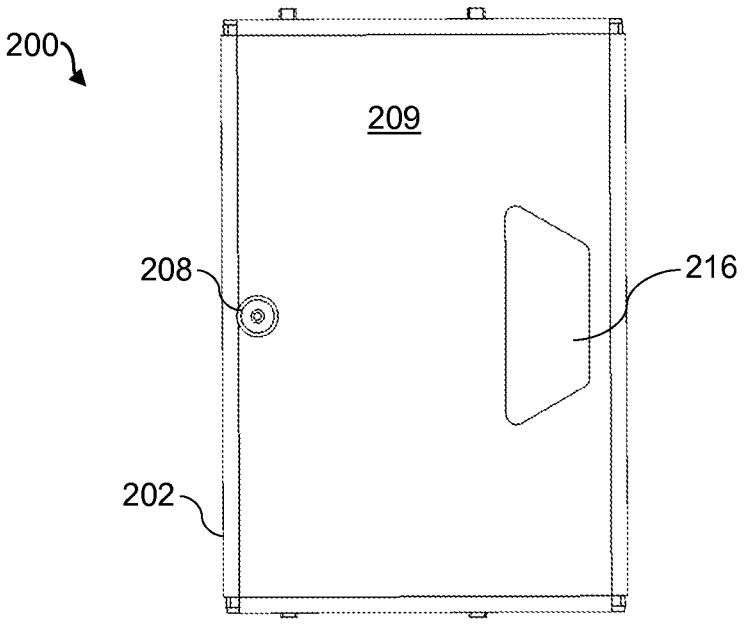
FIG. 2B is a bottom view of an example roller adapter taken along view line 2B.

Referring additionally to FIG. 2B, a bottom view of an example roller adapter 200, as taken along view line 2B of FIG. 2A, is illustrated. In some implementations, the roller adapter 200 may include a handle cavity 216 disposed on the base 209 of the cradle 202. The handle cavity 216 may be an aperture or opening in the cradle 202 material. In implementations where the cradle 202 is constructed of a metallic sheet material such as sheet steel, the handle cavity 216 may be an opening that is stamped through or cut out of the sheet material. The handle cavity 216 may be sized such that a user may be able to grasp or hold the roller adapter 200 and carry it by inserting a hand into the handle cavity 216. In further implementations, the handle cavity 216 may be disposed in a centralized location on the base 209 of the cradle 202, and may be disposed substantially opposite that of the alignment knob or pivot 208. In this context, substantially opposite of the alignment knob 208 may refer to a location for the handle cavity 216 that ensures the alignment knob 208 does not interfere with a user's hand while the roller adapter 200 is being carried by the user.

Figure 3A:
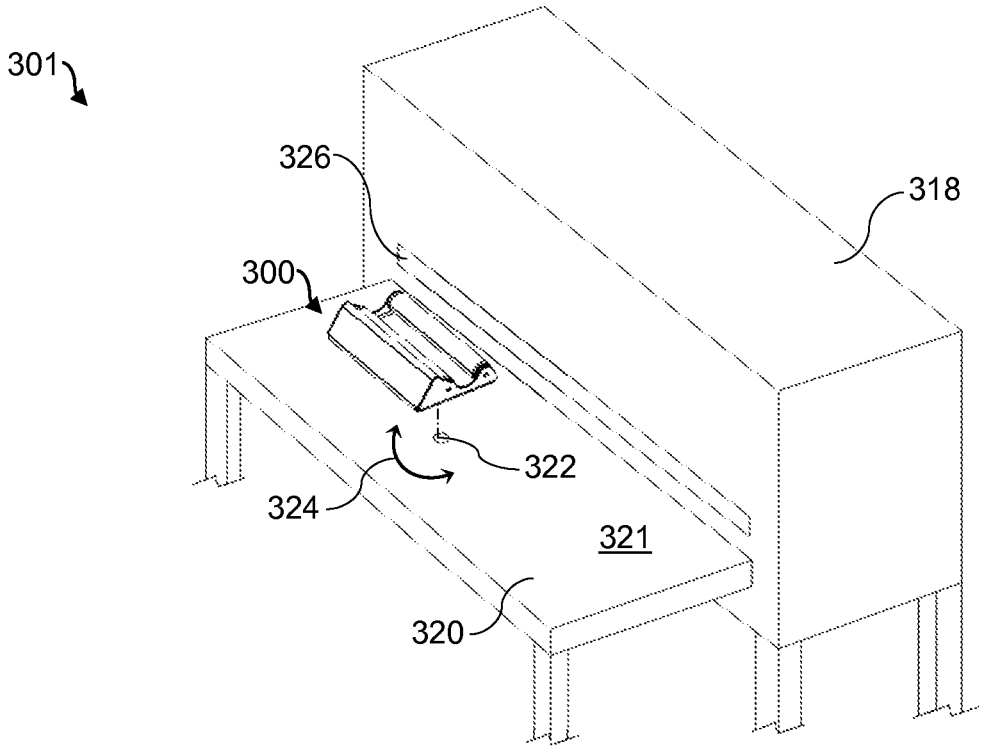
FIG. 3A is a perspective view of a roller adapter system.

Referring now to FIG. 3A, a perspective view of a roller adapter system 301 is illustrated. The roller adapter system 301 may include an example roller adapter 300, an associated printing device such as a printer 318, and a printer media table 320. Example roller adapter 300 may be similar to example roller adapter 100 or 200. Further, the similarly named elements of example roller adapter 300 may be similar in function and/or structure to the elements of example roller adapter 100 or 200, as they are described above. Printer 318 and printer media table 320 may also be similar in function or structure to similarly-named elements described above.

The printer media table 320 may receive and support a rigid printing media for insertion into the associated printer 318, which may be disposed next to or adjacent to the printer media table 320. The printer media table 320 may also receive and support a roll of flexible print media through the use of an example roller adapter 300. The printer media table 320 may be aligned with the printer 318 such that the minter media table 320 may support print media, flexible or rigid, far insertion into an input path 326 of the printer 318 and, thus, through the print zone of the printer 318. Further, the printer media table 320 may structurally engage with the printer 318, in some implementations, so that media disposed upon the table 320 may be set up for proper aligned insertion into the input path 326. In further implementations, the printer media table 320 may be structurally engaged with, or aligned with the printer 318 such that the table 320 may receive print media exiting an output path of the printer 318. In yet further implementations, the roller adapter system 301 may include a printer media table 320 aligned with the input path 326, as well as an additional printer media table 320 aligned with the output path, such that print media is supported upon insertion into the printer 318 and upon exiting the printer 318. The printer media table 320 may include a substantially flat top surface 321 upon which to receive the rigid print media, or, in some implementations, the base or bottom side of an example roller adapter 300. In further implementations, the printer media table 320 may include rollers, transfer balls, or bearings, or other rotational features disposed on the top surface 321 in order to assist in the translation of rigid print media across the top surface 321 and into the input path 326 of the printer 318, or out from the exit path of the printer 318.

The roller adapter system 301 may include an example roller adapter 300 to engage with a printer media table 320, either at the input path 326 of the printer 318, or the output path of the printer 318, or a separate roller adapter 300 for both. The example roller adapter 300 may include an alignment knob or pivot to removably engage with a complementary pivot receptacle or cavity 322 on the printer media table 320 such that the roller adapter 300 can rotate in a direction 324 about the alignment pivot on a top side of the printer media table 320. In some implementations, the printer media table 320 may comprise a plurality of, or multiple complementary pivot receptacles 322 across the top surface 321 of the table. The plurality of complementary pivot receptacles 322 may enable the example roller adapter 300 to be placed in various locations across the top surface 321 of the table, and, therefore, the roller adapter 300 may be able to engage with and support rolls of flexible print media of varying sizes and dimensions.

Figure 3B:
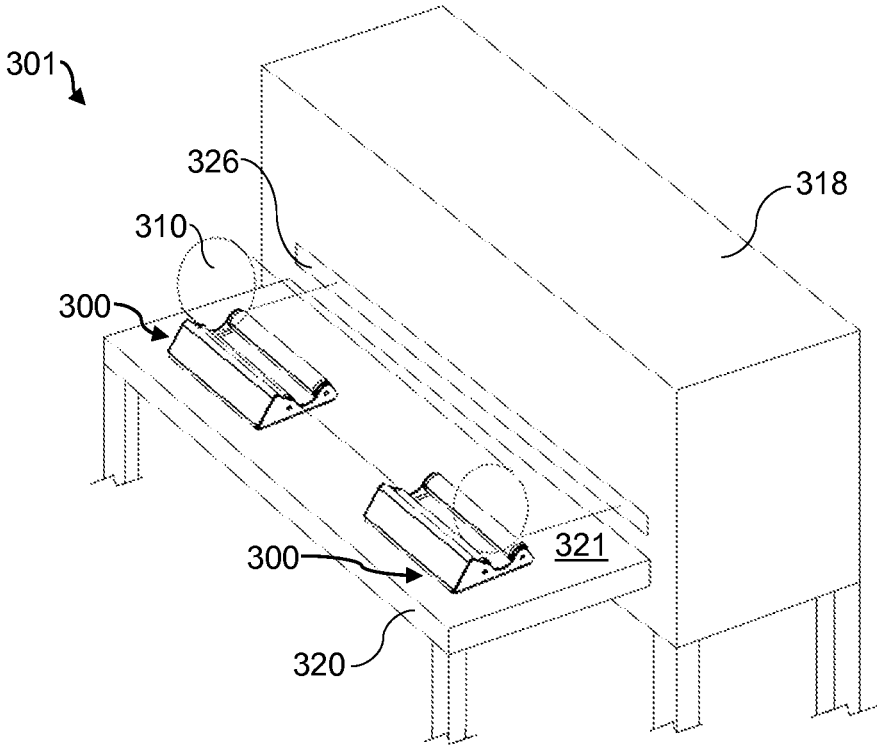
FIG. 3B is a perspective view of a roller adapter system.

Referring now to FIG. 3B, a perspective view of a roller adapter system 301 is illustrated. The roller adapter system 301 may include two or more example roller adapters 300 (for example a first roller adapter and a second roller adapter), in some implementations. Each of the example roller adapters 300 may have an alignment knob or pivot that is engaged with a separate complementary pivot receptacle on the top side 321 of the printer media table 320. Each of the example roller adapters 300 may be adjacent to or laterally aligned with one another across the width of the printer media table 320, such that they both are facing the input path 326 of the primer 318, and, together, the roller adapters 300 may rotatably support a roll flexible print media 310 (shown here in phantom lines so as not to obstruct the illustration of the roller adapters) for insertion into the input path 326. The roller adapters 300 may be variably spaced apart from each other across the top surface 321 to accommodate rolls of flexible prim media 310 having varying widths. The roller adapters 300 may, together, rotatable support the roll of flexible print media 310 such that the flexible print media is aligned with and continuously fed into the input path 326, and, thus, through the print zone of the primer 318.

In some implementations, the roller adapters 300 are to each engage with the roll of flexible print media 310, such that the respective contact with and weight of the roll is to rotate each of the roller adapters about their respective alignment pivots until the roller adapters are both aligned with the input path 326 of the printer 318 disposed adjacent to the printer media table 320. In other words, one or both of the example roller adapters 300 may be set on the top surface 321 of the printer media table 320 so that the alignment knob or pivot of each of the roller adapters 300 is engaged with a separate complementary pivot receptacle 322 that is laterally aligned with the other. Despite the engagement of the alignment knobs with pivot receptacles 322 that are aligned with each other, one or both of the roller adapters 300 may be facing a direction other than straight into the input path 326. The roll of flexible print media 310 may then be lowered on to the roller adapters 300, making contact with the rollers of each of them. The weight of the roll 310 may force the rollers, and thus the respective roller adapters 300 to which they are attached, to rotate in a direction similar to direction 324 of FIG. 3A, about their respective alignment pivots until each of the roller adapters 300 is properly facing the input path 326.

Figure 3C:
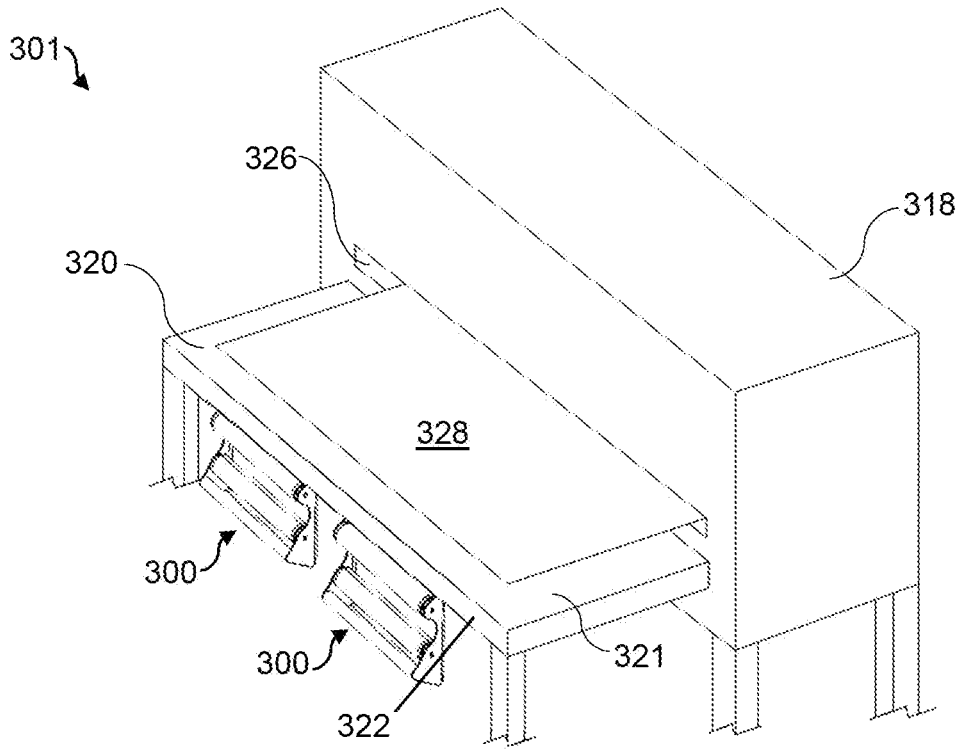
FIG. 3C is a perspective view of a roller adapter system.

Referring now to FIG. 3C, a perspective view of a roller adapter system 301 is illustrated. In some implementations, it may be desirable to switch from printing on the roll of flexible print media 310, to printing on rigid print media 328. In some implementations, the printer media table 320 may have a secondary complementary pivot cavity or receptacle to receive the alignment pivot or knob of an example roller adapter 300. The printer media table 320 may include a plurality of, or multiple secondary complementary pivot receptacles, such that an example roller adapter 300 may engage with any one of them. In some implementations, the printer media table 320 may include a secondary complementary pivot receptacle disposed on a side 322 other than the top surface 321 of the printer media table 320 such that the roller adapter 300 can hang from the secondary complementary cavity in a stowed fashion. In further implementations, the printer media table 320 may have a plurality of secondary complementary pivot receptacles disposed underneath the top surface 321 of the table 320 such that multiple example roller adapters 300 may hang from the receptacles in a stowed fashion, as illustrated in FIG. 3C. Note, the secondary complementary pivot receptacles are not shown in FIG. 3C, as they are concealed by the top surface 321. The example roller adapters 300 may each be disengaged from the table 320 by lifting the adapter 300 off of the top surface 321 of the table 320 such that the adapter's alignment pivot is lifted out of the complementary receptacle retaining it. Once the roller adapters 300 are disengaged from the top surface 321 of the printer media table 320, the roller adapters 300 may be stowed or hung from one of the secondary complementary receptacles, and the top surface 321 may receive a rigid print media 328. The rigid print media 328 may then be properly aligned with the input path 326 of the printer 318, and fed into the input path, and thus, through the print zone of the printer 318.

What is claimed is:

1. A roller adapter, comprising:

a cradle;

a first roller rotatably disposed on a top side of the cradle;

a second roller rotatably disposed on the top side of the cradle, wherein the first and second rollers extend in substantially parallel directions; and an alignment feature disposed on a base of the cradle, wherein the cradle comprises a support surface extending from the base of the cradle to a first height that is higher than a top-most surface of the second roller, wherein the first roller and the second roller are to rotatably support a roll of flexible print media.

2. The roller adapter of claim 1, wherein the alignment feature depends from a bottom surface of the base of the cradle, and the alignment feature is removably and pivotally engageable with a complementary pivot cavity on a printer media table such that the roller adapter can pivot about the alignment feature on a top surface of the printer media table.

3. The roller adapter of claim 2, wherein the alignment feature is to removably engage with a secondary complementary pivot cavity disposed on a side other than the top surface of the printer media table, to stow the roller adapter by hanging the roller adapter from the secondary complementary pivot cavity.

4. The roller adapter of claim 1, wherein the first and second rollers together are to rotatably support the roll of flexible print media having a diameter that is greater than a perpendicular distance between the closest edges of the first and second rollers.

5. The roller adapter of claim 1, wherein a top surface of the support surface is higher by a height differential than the top-most surface of the second roller to allow the support surface to engage the roll of flexible print media when the roll of flexible print media moves over the second roller in a direction away from the first roller.

6. The roller adapter of claim 1, wherein the cradle comprises a handle cavity disposed on a bottom side of the cradle such that a user can hold the roller adapter by the handle cavity.

7. The roller adapter of claim 1, wherein the cradle has a side portion, the first roller has a spindle rotatably engaged with a first part of the side portion, and the second roller has a spindle rotatably engaged with a second part of the side portion, wherein the side portion has an intermediate part between the first part and the second part, and wherein the first part, the intermediate part, and the second part are integrally formed and are part of a unitary structure.

8. The roller adapter of claim 7, wherein a surface of the intermediate part is lower than a top-most surface of the first part, and a top-most surface of the second part.

9. The roller adapter of claim 8, wherein the support surface comprises the top-most surface of the second part.

10. The roller adapter of claim 8, wherein the intermediate part has an arc-shaped surface that interconnects the first part and the second part.

11. A roller adapter, comprising:

a frame having a unitary side structure;

a first roller and a second roller disposed within the frame and extending in substantially parallel directions, wherein the first roller has a spindle rotatably engaged with a first part of the unitary side structure, and the second roller has a spindle rotatably engaged with a second part of the unitary side structure, and wherein the unitary side structure has an intermediate part integrally connecting the first part and the second part, wherein the first and second rollers are to receive and rotatably support a roll of flexible print media such that the flexible print media is continuously fed into an input path of a printer; and an alignment pivot disposed on an opposite side of the frame from the first and second rollers.

12. The roller adapter of claim 11, wherein the alignment pivot is to removably and pivotally engage with a complementary pivot receptacle on a printer media table such that the roller adapter is rotatable about the alignment pivot on a top surface of the printer media table.

13. The roller adapter of claim 12, wherein the input path of the printer is disposed adjacent to the printer media table.

14. The roller adapter of claim 13, wherein the alignment pivot is to allow the roller adapter to rotate on the top surface of the printer media table such that the roller adapter can align with the input path of the printer.

15. A system, comprising:

a printer media table; and a first roller adapter removably engaged with a top surface of the printer media table, the first roller adapter comprising:

a cradle;

a first roller rotatably disposed on a top side of the cradle;

a second roller rotatably disposed on the top side of the cradle, wherein the first and second rollers extend in substantially parallel directions, wherein the first roller and the second roller are to rotatably support a roll of flexible print media; and an alignment pivot disposed on a bottom side of the cradle, wherein the bottom side is opposite from the first top side, wherein the alignment pivot removably and pivotally engages with a complementary pivot receptacle on the printer media table to allow rotation of the first roller adapter about the alignment pivot on the top surface of the printer media table.

16. The system of claim 15, further comprising a second roller adapter comprising an alignment pivot that removably and pivotally engages with another complementary pivot receptacle in the top surface of the printer media table.

17. The system of claim 16, wherein the first and second roller adapters are to each engage with the roll of flexible print media.

18. The system of claim 17, wherein the first and second roller adapters are to, together, rotatably support the roll of flexible print media such that the flexible print media is continuously fed into an input path of a printer.

19. The system of claim 15, wherein the first roller adapter is rotatable with respect to the top surface of the printer media table while the alignment pivot is engaged with the complementary pivot receptacle on the printer media table.

20. The system of claim 15, wherein the complementary pivot receptacle is in the top surface of the printer media table, and wherein the printer media table further comprises a further complementary pivot receptacle arranged on a side of the printer media table, the side different from the top surface of the printer media table, and wherein the alignment pivot of the first roller adapter is removable from the complementary pivot receptacle in the top surface of the printer media table, and is engageable with the further complementary pivot receptacle after removing the alignment pivot from the complementary pivot receptacle in the top surface of the printer media table.

* * * * *